US011649418B2

(12) United States Patent
Zheng et al.

(10) Patent No.: US 11,649,418 B2
(45) Date of Patent: May 16, 2023

(54) METHOD FOR INHIBITING FLASH POINT OF TRANS-1,2-DICHLOROETHYLENE (T-1,2-DCE) AND USE OF T-1,2-DCE

(71) Applicant: ZIBO RHEMA INTERNATIONAL INC., Zibo (CN)

(72) Inventors: Farui Zheng, Zibo (CN); Yawei Zheng, Zibo (CN); Panming Jian, Zibo (CN); Zihan Zheng, Zibo (CN)

(73) Assignee: ZIBO RHEMA INTERNATIONAL INC., Zibo (CN)

( * ) Notice: Subject to any disclaimer, the term of this patent is extended or adjusted under 35 U.S.C. 154(b) by 0 days.

(21) Appl. No.: 17/799,929

(22) PCT Filed: Jan. 21, 2021

(86) PCT No.: PCT/CN2021/072973
§ 371 (c)(1),
(2) Date: Aug. 16, 2022

(87) PCT Pub. No.: WO2022/083018
PCT Pub. Date: Apr. 28, 2022

(65) Prior Publication Data

US 2023/0073016 A1 Mar. 9, 2023

(30) Foreign Application Priority Data

Oct. 20, 2020 (CN) ..... 202011124654.7

(51) Int. Cl.

| | |
|---|---|
| ***C11D 7/30*** | (2006.01) |
| ***B08B 3/00*** | (2006.01) |
| ***C11D 7/50*** | (2006.01) |
| ***C11D 11/00*** | (2006.01) |

(52) U.S. Cl.
CPC ..... *C11D 7/30* (2013.01); *B08B 3/00* (2013.01); *C11D 7/5018* (2013.01); *C11D 11/0047* (2013.01); *B08B 2230/01* (2013.01)

(58) Field of Classification Search
CPC ..... C11D 7/30; C11D 11/0047
USPC ..... 510/175
See application file for complete search history.

(56) References Cited

U.S. PATENT DOCUMENTS

2022/0348808 A1* 11/2022 Kawaguchi ..... B08B 3/08

FOREIGN PATENT DOCUMENTS

| | | | |
|---|---|---|---|
| CN | 105802584 | A | 7/2016 |
| CN | 105802584 | B | 6/2018 |
| CN | 108367285 | A | 8/2018 |
| CN | 111662792 | A | 9/2020 |
| CN | 112029596 | A | 12/2020 |
| WO | 2011089344 | A1 | 7/2011 |
| WO | 2018101324 | A1 | 6/2018 |
| WO | 2019189024 | A1 | 10/2019 |

OTHER PUBLICATIONS

GB/T 5208-2008, Determination of flash point-Rapid equilibrium closed cup method, Administration of Quality Supervision, Inspection and Quarantine of People's Republic of China; Standardization Administration of China, 2008, pp. 1-14.

* cited by examiner

*Primary Examiner* — Gregory E Webb
(74) *Attorney, Agent, or Firm* — Bayramoglu Law Offices LLC

(57) ABSTRACT

A method for inhibiting a flash point of trans-1,2-dichloroethylene (T-1,2-DCE) and a use of T-1,2-DCE are provided. The T-1,2-DCE has an excellent cleaning effect and is environmental friendly but cannot be used alone because of huge safety hazard caused by its low flash point. 1-chloro-3,3,3-trifluoropropene (HCFO-1233zd) is used to inhibit the flash point of T-1,2-DCE. However, because the actual boiling points of these two substances are quite different, the two substances are easily separated at a slightly-high ambient temperature. Because a boiling point of HCFO-1233zd is extremely low, HCFO-1233zd will escape rapidly, resulting in the loss of inhibition on the flash point. In the present disclosure, T-1,2-DCE and 1-chloro-2,3,3-trifluoropropene are mixed to prepare a mixed solution, and the mixed solution can effectively maintain the inhibition on the flash point of T-1,2-DCE in various ambient temperatures, such that the T-1,2-DCE can be heated to generate a steam for cleaning.

7 Claims, No Drawings

METHOD FOR INHIBITING FLASH POINT OF TRANS-1,2-DICHLOROETHYLENE (T-1,2-DCE) AND USE OF T-1,2-DCE

CROSS REFERENCE TO THE RELATED APPLICATIONS

This application is the national phase entry of International Application No. PCT/CN2021/072973, filed on Jan. 21, 2021, which is based upon and claims priority to Chinese Patent Application No. 202011124654.7, filed on Oct. 20, 2020, the entire contents of which are incorporated herein by reference.

TECHNICAL FIELD

The present disclosure discloses a method for inhibiting a flash point of trans-1,2-dichloroethylene (T-1,2-DCE) and a use of T-1,2-DCE and belongs to the technical field of inhibiting a flash point of T-1,2-DCE.

BACKGROUND

With ozone depletion potential (ODP) and global warming potential (GWP) both zero, T-1,2-DCE has been widely used in industrial cleaning agents and solvents to clean and degrease metal parts, substrates, electronic devices, and electronic circuit boards; dry-clean clothing and leather; and dilute silicone oil, fluorine-containing oil, and a rust inhibitor. However, T-1,2-DCE itself has a flash point, which poses as a safety problem in its practical applications. Therefore, inhibiting the flash point of T-1,2-DCE must be solved in the applications of T-1,2-DCE.

The inhibition of the flash point of T-1,2-DCE has been reported in many patent documents. The Minnesota Mining and Manufacturing (3M) company of the United States invented multiple inhibition solutions of compositions of T-1,2-DCE with hydrofluoroethers (HFEs), such as HFE-7100, HFE-7200, and HFE-7300. The Chemours Company of the United States developed inhibition solutions, such as a composition of T-1,2-DCE and HFC-4310 and a composition of T-1,2-DCE, HFC-4310, and HFX-110. In all of the above solutions, an HFE compound is used to inhibit the flash point of T-1,2-DCE and HFE is costly, which makes T-1,2-DCE less marketable.

Patents WO2011/089344 and CN 105802584 B both disclose a composition of T-1,2-DCE and 1-chloro-3,3,3-trifluoropropene (HCFO-1233zd) as a cleaning composition and an inhibition of a flash point of T-1,2-DCE. It can be understood that this technical solution is as follows: HCFO-1233zd and T-1,2-DCE are mixed at room temperature to reduce a concentration of T-1,2-DCE in the air, thereby achieving the inhibition on the flash point. However, trans-1-chloro-3,3,3-trifluoropropene has a boiling point of about 15° C. and thus can be volatilized into a high-concentration gaseous state at room temperature. When it is actually used in an environment at 45° C. or above, T-1,2-DCE is also at a temperature close to or reaching its boiling point (about 47.7° C.), such that a concentration of T-1,2-DCE near a liquid level increases sharply, a partial pressure of HCFO-1233zd decreases, and a concentration per unit volume near the liquid level decreases, in which case, the two substances are completely separated, the effect of inhibition on the flash point is lost, and the flash point of T-1,2-DCE drops rapidly. Therefore, this solution is suitable for foaming at room temperature, but not suitable for steam cleaning in a closed environment. Due to the low boiling point, HCFO-1233zd escapes easily from a closed environment at a high temperature, and thus is not suitable for repeated cleaning in machine cleaning systems.

SUMMARY

The technical problem to be solved by the present disclosure: In order to overcome the deficiencies of the prior art, the present disclosure provides a method for stably inhibiting a flash point of T-1,2-DCE in various temperature environments to realize a use of T-1,2-DCE in the steam cleaning of an object, which has no risk of potentially enhancing the greenhouse effect and is cost-effective, and a use of T-1,2-DCE.

The present disclosure adopts the following technical solutions to solve the technical problem: A method for inhibiting a flash point of T-1,2-DCE is provided including: mixing the T-1,2-DCE with 1-chloro-2,3,3-trifluoropropene (HCFO-1233yd (E/Z)) to obtain a mixed solution in which the 1-chloro-2,3,3-trifluoropropene accounts for 3% to 90% by weight.

The inventors have discovered that 1-chloro-2,3,3-trifluoropropene (E/Z) itself has a boiling point of 54° C., and trans-1-chloro-2,3,3-trifluoropropene has a boiling point of 48° C., which are closer to a boiling point of T-1,2-DCE than the boiling point (15° C.) of HCFO-1233zd. Thus, the 1-chloro-2,3,3-trifluoropropene can be mixed with T-1,2-DCE to produce an azeotropic or nearly-azeotropic mixed solution. The mixed solution can ensure that T-1,2-DCE and the 1-chloro-2,3,3-trichloroethylene in a gas generated near a liquid level of the mixed solution at any ambient or system temperature are in the same ratio as in the mixed solution, such that the same effect of inhibiting the flash point of T-1,2-DCE can be exhibited under all temperature conditions. There will be no case where the two components in the gas phase are completely separated due to a temperature far exceeding a boiling point one of the two components, which further leads to different effects of inhibiting the flash point at different temperatures and even results in the loss of inhibition on the flash point at a temperature near the boiling point of T-1,2-DCE. Since the two components of the present disclosure are always mixed thoroughly, the requirements of repeated use of a cleaning agent in a machine cleaning system can be met. In addition, 1-chloro-2,3,3-trifluoropropene itself has extremely low ODP and GWP and high environmental friendliness and will not affect other properties of T-1,2-DCE itself.

Preferably, the method may include: mixing the T-1,2-DCE with the 1-chloro-2,3,3-trifluoropropene to obtain a mixed solution in which the 1-chloro-2,3,3-trifluoropropene accounts for 5% to 50% by weight. The higher the content of 1-chloro-2,3,3-trifluoropropene in the mixed solution, the stronger the inhibition on the flash point of T-1,2-DCE; the lower the content, the higher the cleaning effect.

Preferably, the method may include: mixing the T-1,2-DCE with the 1-chloro-2,3,3-trifluoropropene to obtain a mixed solution in which the 1-chloro-2,3,3-trifluoropropene accounts for 10% to 20% by weight. Within the above ratio range, the two components in a steam produced from volatilization of the mixed solution can be in a ratio close to that of the mixed solution at any system temperature. That is, at any ambient or system temperature, the mixed solution can exhibit a stable and uniform inhibition effect on the flash point; and an approximate azeotropic temperature of the mixed solution is closest to the boiling point of T-1,2-DCE, that is, a steam of the mixed solution exhibits the optimal cleaning effect of T-1,2-DCE.

A preparation method of the 1-chloro-2,3,3-trifluoropropene may include the following steps: 1) subjecting 1,1,2,3,3-pentachloropropane and hydrogen fluoride to a reaction at a temperature of 200° C. to 350° C. and a space velocity of 60 $h^{-1}$ to 570 $h^{-1}$ under the catalysis of a chromium-based catalyst to generate 1,2-dichloro-3,3-difluoropropene (E, Z) ($CHCl{=}CCl{-}CHF_2$) (HCFO-1232aa), where a ratio of the hydrogen fluoride to the 1,1,2,3,3-pentachloropropane is (5-25):1; and 2) subjecting the 1,2-dichloro-3,3-difluoropropene and hydrogen fluoride to a reaction at a temperature of 250° C. to 400° C. and a space velocity of 50 $h^{-1}$ to 550 $h^{-1}$ under the catalysis of a catalyst to generate the 1-chloro-2,3,3-trifluoropropene (E/Z) ($CHCl{=}CF{-}CHF_2$) (HCFO-1233yd), where the catalyst includes a main catalyst and a cocatalyst, where the main catalyst is a chromium-based catalyst treated with hydrogen fluoride and the cocatalyst is one selected from the group consisting of Zn, Co, Ni, and Cu; and a ratio of the hydrogen fluoride to the 1,2-dichloro-3,3-difluoropropene is (1-8):1.

The chromium-based catalyst may be a catalyst, such as chromium-loaded activated carbon and zirconium oxychloride.

The above method can lead to 1-chloro-2,3,3-trifluoropropene with a boiling point of about 54° C., which can effectively inhibit the flash point of T-1,2-DCE after being mixed with T-1,2-DCE. In particular, even when at an approximate azeotropic temperature, the composition of T-1,2-DCE and 1-chloro-2,3,3-trifluoropropene can still ensure that there is no flash point of T-1,2-DCE after being used repeatedly.

The mixed solution has no flash point before boiling. Since the ratio of the two components remains stable at various temperatures before the mixed solution boils, it can be achieved that there is still a prominent effect of inhibiting the flash point at an approximate azeotropic temperature, that is, when a temperature of the mixed solution is about 47° C.

Preferably, the 1-chloro-2,3,3-trifluoropropene may be trans-1-chloro-2,3,3-trifluoropropene.

1-Chloro-2,3,3-trifluoropropene is actually a mixture of cis-1-chloro-2,3,3-trifluoropropene and trans-1-chloro-2,3,3-trifluoropropene, namely, 1-chloro-2,3,3-trifluoropropene (E/Z). The present disclosure mainly utilizes the boiling point (48° C.) of trans-1-chloro-2,3,3-trifluoropropene, which is close to the boiling point (47.67° C.) of T-1,2-DCE, and thus a proportion of trans-1-chloro-2,3,3-trifluoropropene in the 1-chloro-2,3,3-trifluoropropene (E/Z) mixture can be increased to make its advantages of flash point inhibition and approximate azeotropism more prominent. When the proportion of trans-1-chloro-2,3,3-trifluoropropene is greater than or equal to 95%, a proportion of trans-1-chloro-2,3,3-trifluoropropene in the composition of T-1,2-DCE and 1-chloro-2,3,3-trifluoropropene can be easily adjusted to obtain cleaning agents with different cleaning values (KB values) of 44 to 124, which can meet the cleaning requirements of different cleaning objects.

A use of T-1,2-DCE is provided, including: using the mixed solution obtained by the method for inhibiting a flash point of T-1,2-DCE described above to prepare a cleaning agent.

The constituent components of the composition are all excellent new environmentally-friendly cleaning solvents. The composition can serve as a spray cleaning agent, a dry cleaning agent for leather clothes, a machine cleaning agent, and a diluent for silicone oil, fluorine-containing oil, a rust inhibitor, or the like and can also be widely used in solvents for processes, such as low-temperature extraction, deinking, and degreasing. The above-mentioned method for inhibiting the flash point of T-1,2-DCE can truly achieve the same effect of inhibiting the flash point of T-1,2-DCE in various temperature environments, such that a T-1,2-DCE steam can be used to clean various objects to fully clean various dead corners and crevices.

Preferably, the mixed solution cleaning agent may be placed in a closed space and heated to 45° C. to 50° C., and an object to be cleaned may be placed above a liquid level to undergo steam washing in a cooling state.

The present disclosure considers the use of T-1,2-DCE in mid-end and high-end industrial cleaning, namely, machine cleaning. Since the method for inhibiting the flash point of T-1,2-DCE discovered by the present disclosure can be used to inhibit the flash point at a system temperature close to the boiling point of T-1,2-DCE, machine components with special requirements can be cleaned by heating evaporation. The excellent cleaning effect of T-1,2-DCE, in combination with the temperature effect and high permeability of steam, can achieve a superior cleaning effect. With the method of the present disclosure, precision devices or devices sensitive to other media can be cleaned repeatedly, fully, and safely. Since the boiling point of 1-chloro-2,3,3-trifluoropropene is close to the boiling point of T-1,2-DCE, the two components in a steam resulting from boiling evaporation are thoroughly mixed and there will be no uneven partial pressure. Therefore, 1-chloro-2,3,3-trifluoropropene does not evaporate easily, a replenishment amount is small, and the entire cleaning system can be repeatedly used, which can meet the cleaning requirements and greatly reduce the use cost and the pollution to environments such as ozonosphere.

Preferably, the object to be cleaned may be a mechanical component and an electronic device. The 1-chloro-2,3,3-trifluoropropene can lead to a superior cleaning effect for a mechanical component when used for steam cleaning.

Beneficial Effects

Compared with the prior art, the present disclosure has the following beneficial effects: The flash point of T-1,2-DCE can be completely inhibited before the approximate azeotropic point of the composition is achieved, such that the mixture of T-1,2-DCE and 1-chloro-2,3,3-trifluoropropene can be heated to boiling for evaporation that releases steam to completely and repeatedly clean various objects through steam cleaning, thereby achieving a superior cleaning effect. In addition, when the composition of T-1,2-DCE and 1-chloro-2,3,3-trifluoropropene is used to clean an object, due to the sealing of a cleaning machine and the cooling of the cleaning object, a steam of the cleaning agent can condense into a liquid for repeated cleaning when cooled, such that the composition does not easily escape and does not need to be supplemented, and the damage to the environment (especially the ozonosphere) is reduced.

DETAILED DESCRIPTION OF THE EMBODIMENTS

Example 10 is the optimal example of the present disclosure, and the present disclosure will be further described below with reference to examples.

The main component T-1,2-DCE is manufactured by China Ningxia Purui Chemical Co., Ltd., and a main content thereof is higher than or equal to 99.9%.

EXAMPLES 1 TO 8 AND COMPARATIVE EXAMPLES 1 TO 3

A preparation method of 1-chloro-2,3,3-trifluoropropene was provided, including the following steps: 1) 1,1,2,3,3-pentachloropropane and hydrogen fluoride were subjected to a reaction at a temperature of 275° C. and a space velocity of 240 $h^{-1}$ under the catalysis of a F-$Cr_{2O3}$ catalyst produced by Shandong Zibo Feiyuan Chemical Co., Ltd. to generate 1,2-dichloro-3,3-difluoropropene (E/Z) (CHCl=CCl—$CHF_2$) (HCFO-1232aa), where a ratio of the hydrogen fluoride to the 1,1,2,3,3-pentachloropropane was 15:1; and 2) the 1,2-dichloro-3,3-difluoropropene and hydrogen fluoride were subjected to a reaction at a temperature of 300° C. and a space velocity of 220 $h^{-1}$ under the catalysis of a catalyst to generate the 1-chloro-2,3,3-trifluoropropene (E/Z) (CHCl=CF—$CHF_2$) (HCFO-1233yd), where the catalyst was a Cr—Co—Zn composite catalyst produced by Shandong Zibo Feiyuan Chemical Co., Ltd.; and a ratio of the hydrogen fluoride to the 1,2-dichloro-3,3-difluoropropene was 4:1.

A method for inhibiting a flash point of T-1,2-DCE was provided, including: mixing the T-1,2-DCE with 1-chloro-2,3,3-trifluoropropene to obtain a mixed solution in which the 1-chloro-2,3,3-trifluoropropene accounted for 3% to 90% by weight. A mixing ratio of the T-1,2-DCE and 1-chloro-2,3,3-trifluoropropene in each example is shown in Table 1 below. T-1,2-DCE is trans-1,2-dichloroethylene, 1233yd is a cis/trans-1-chloro-2,3,3-trifluoropropene mixture prepared by the above-mentioned preparation method of 1-chloro-2,3,3-trifluoropropene, and T-DEC/1233yd is a weight ratio of the T-1,2-DCE to the 1-chloro-2,3,3-trifluoropropene.

A use of T-1,2-DCE was provided. The mixed solution of T-1,2-DCE and 1-chloro-2,3,3-trifluoropropene (E/Z) obtained in Example 1 was placed in a closed constant-temperature box, heated, and kept at 47° C. A volume of the mixed solution was about 30% of a volume of the box and a weight ratio of the T-1,2-DCE to the 1-chloro-2,3,3-trifluoropropene (E/Z) was 90:10. A hollow steel pipe with a bend angle of 90°, a diameter of 1 mm, and a length of 15 cm was fixed at an inner top of the box with a distance of 30 cm from a liquid level, which was blocked by organic oil dirt inside. The steel pipe was cooled and kept at temperature lower than 25° C. to undergo steam cleaning for 1 h and then taken out and observed. It was found that the organic oil inside the steel pipe was mostly dissolved and two ends of the steel pipe were connected.

With the volume of the mixed solution being only 30% of the volume of the box, the whole process did not require liquid supplementation, indicating that the 1-chloro-2,3,3-trifluoropropene did not escape. The prominent steam cleaning effect proved that the T-1,2-DCE and 1-chloro-2,3,3-trifluoropropene (E/Z) in the steam did not separate and the excellent approximate azeotropic effect was still maintained. Thus, the T-1,2-DCE can be used for thorough cleaning of special components or machinery on a large scale.

TABLE 1

| | Mixing ratio | | | | | | | | | | |
|---|---|---|---|---|---|---|---|---|---|---|---|
| | Example 1 | Example 2 | Example 3 | Example 4 | Example 5 | Example 6 | Example 7 | Example 8 | Comparative Example 1 | Comparative Example 2 | Comparative Example 3 |
| T-1,2-DCE/1233yd | 97/3 | 96/4 | 90/10 | 80/20 | 70/30 | 60/40 | 50/50 | 10/90 | 100/0 | 99/1 | 98/2 |

Examples 9 to 13 A method for inhibiting a flash point of T-1,2-DCE was provided. The preparation method of 1-chloro-2,3,3-trifluoropropene in Example 1 was repeated. The prepared 1-chloro-2,3,3-trifluoropropene was subjected to rectification to obtain trans-1-chloro-2,3,3-trifluoropropene with a boiling point of 47.67° C., and the T-1,2-DCE was mixed with the obtained trans-1-chloro-2,3,3-trifluoropropene to obtain a mixed solution in which the trans-1-chloro-2,3,3-trifluoropropene accounted for 3% to 90% by weight. A mixing ratio in each example was shown in Table 2 below. 1233yd (E) is trans-1-chloro-2,3,3-trifluoropropene.

TABLE 2

Mixing ratios of T-1,2-DCE and 1233yd (E)

| | Example 9 | Example 10 | Example 11 | Example 12 | Example 13 |
|---|---|---|---|---|---|
| T-1,2-DCE/ 1233yd (E) | 97/3 | 90/10 | 80/20 | 70/30 | 60/40 |

Performance test 1 According to the national standard GB/T 5208-2008/ISO 3679: 2004, a closed cup flash point of the mixed solution of T-1,2-DCE and 1-chloro-2,3,3-trifluoropropene was determined. The samples obtained in the above examples and comparative examples were each placed in a room at 0° C., then the temperature of the room was lowered to −18° C., and the humidity of the room was set to 45%. The flash point was determined 3 times at each temperature test point, and test results were recorded in Table 3, where N/A means that the flash point had been reached and thus the test was stopped.

TABLE 3

Flash point test results

| | | Flash point of T-1,2-DCE: 1233yd (yes/no) | | | | | | | |
|---|---|---|---|---|---|---|---|---|---|
| Test temperature/ ° C. | Comparative Example 1 | Comparative Example 2 | Comparative Example 3 | Example 1 | Example 2 | Example 3 | Example 4 | Example 5 | Example 8 |
| −15 | No | No | No | No | No | No | No | No | No |
| −12 | No | No | No | No | No | No | No | No | No |
| −10 | No | No | No | No | No | No | No | No | No |
| −8 | No | No | No | No | No | No | No | No | No |
| −4 | Yes | Yes | Yes | No | No | No | No | No | No |
| 0 | N/A | N/A | N/A | No | No | No | No | No | No |
| 10 | N/A | N/A | N/A | No | No | No | No | No | No |
| 20 | N/A | N/A | N/A | No | No | No | No | No | No |
| 30 | N/A | N/A | N/A | No | No | No | No | No | No |
| 47 | N/A | N/A | N/A | No | No | No | No | No | No |
| 50 | N/A | N/A | N/A | Yes | No | No | No | No | No |

According to the results in Table 3, when the 1-chloro-2,3,3-trifluoropropene in the mixed solution prepared by the method for inhibiting the flash point of T-1,2-DCE of the present disclosure accounts for 3% to 90% by weight, the mixed solution can exhibit an excellent effect of inhibiting the flash point. When the 1-chloro-2,3,3-trifluoropropene accounts for only 1% to 2% by weight, the effect of inhibiting the flash point drops sharply. It is known that the boiling point of T-1,2-DCE is about 47° C. to 48° C., and thus it can be known from Examples 2 to 8 that the mixed solution still can exhibit the effect of inhibiting the flash point of T-1,2-DCE when the boiling point is reached. When 1-chloro-2,3,3-trifluoropropene accounts for 90% or higher by weight in the mixed solution, the cleaning effect will be significantly reduced due to the too-low T-1,2-DCE content.

Performance test 2 The azeotropic point of the mixed solution of T-1,2-DCE and 1-chloro-2,3,3-trifluoropropene was determined by an azeotropic point test device designed by Qilu Petrochemical Research Institute of China Petroleum & Chemical Corporation. The azeotropic point test device was composed of a rectification balance kettle, a pure water boiling point meter, a mercury manometer, a condenser, two buffer bottles, an automatic balance controller, two relays, two solenoid valves, and several glass tubes. The azeotropic point test device was used in combination with a gas chromatograph and a data processor to obtain test data and integration results thereof. The above Examples 1 to 13 and Comparative Examples 2 to 3 were subjected to approximate azeotropic distillation on this device, and test result were shown in table 4.

TABLE 4

Approximate azeotropic temperature test results

| Mixing ratio of raw materials (T-1,2-DCE:1233yd) | Humidity (%)/ Corrected gas pressure (kPa) | Ratio of components at distillation tower top (T-1,2-DCE:1233yd) | Approximate azeotropic temperature (° C.) |
|---|---|---|---|
| Comparative Example 2 | 45/101.3 | 98.33:1.67 | 40.6 |
| Comparative Example 3 | 45/101.3 | 97.53:2.47 | 41.1 |
| Example 1 | 45/101.3 | 97.16:2.84 | 45.3 |
| Example 2 | 45/101.3 | 95.49:4.51 | 46.5 |
| Example 3 | 45/101.3 | 89.89:10.11 | 47.1 |
| Example 4 | 45/101.3 | 79.81:20.19 | 46.1 |
| Example 5 | 45/101.3 | 69.71:30.29 | 45.3 |

TABLE 4-continued

Approximate azeotropic temperature test results

| Mixing ratio of raw materials (T-1,2-DCE:1233yd) | Humidity (%)/ Corrected gas pressure (kPa) | Ratio of components at distillation tower top (T-1,2-DCE:1233yd) | Approximate azeotropic temperature (° C.) |
|---|---|---|---|
| Example 6 | 45/101.3 | 58.24:41.76 | 44.8 |
| Example 7 | 45/101.3 | 48.78:51.22 | 44.2 |
| Example 9 | 45/101.3 | 96.89:3.11 | 47.1 |
| Example 10 | 45/101.3 | 89.87:10.13 | 47.3 |
| Example 11 | 45/101.3 | 79.78:20.22 | 46.5 |

TABLE 4-continued

| Approximate azeotropic temperature test results | | | |
|---|---|---|---|
| Mixing ratio of raw materials (T-1,2-DCE:1233yd) | Humidity (%)/ Corrected gas pressure (kPa) | Ratio of components at distillation tower top (T-1,2-DCE:1233yd) | Approximate azeotropic temperature (° C.) |
| Example 12 | 45/101.3 | 69.69:30.31 | 45.6 |
| Example 13 | 45/101.3 | 59.49:40.51 | 45.1 |

According to Table 4, when the mixed solution of T-1,2-DCE and 1-chloro-2,3,3-trifluoropropene prepared by the method for inhibiting the flash point of T-1,2-DCE of the present disclosure reaches its boiling point, namely, the approximate azeotropic point, a ratio of the two components in a steam at a tower top remains similar to that in the mixed solution, which can prove that the 1-chloro-2,3,3-trifluoropropene can still exhibit a stable effect of inhibiting the flash point when the T-1,2-DCE is boiled and evaporated at an ambient temperature, and thus a steam of the mixed solution can be used for cleaning or other special purposes. Under the same mixing ratio of raw materials, when the pure trans-1-chloro-2,3,3-trifluoropropene is used as a flash point inhibitor, a mixing ratio of the T-1,2-DCE and the trans-1-chloro-2,3,3-trifluoropropene in a steam obtained from the evaporation of the mixed solution is close to a mixing ratio of the two components in the mixed solution, and thus an effect close to approximate azeotropism can be achieved, that is, a superior effect of inhibiting the flash point can be achieved.

The above are merely preferred examples of the present disclosure and are not intended to limit the present disclosure in other forms. Any person skilled in the art may make changes or modifications based on the technical contents disclosed above to obtain equivalent examples. Any simple amendments or equivalent changes and modifications made to the above examples according to the technical essence of the present disclosure without departing from the content of the technical solutions of the present disclosure should fall within the protection scope of the technical solutions of the present disclosure.

What is claimed is:

1. A method for inhibiting a flash point of trans-1,2-dichloroethylene (T-1,2-DCE), comprising: mixing the T-1,2-DCE with 1-chloro-2,3,3-trifluoropropene to obtain a mixed solution, wherein the 1-chloro-2,3,3-trifluoropropene accounts for 10% to 20% by weight of the mixed solution.

2. The method for inhibiting the flash point of the T-1,2-DCE according to claim 1, wherein a preparation method of the 1-chloro-2,3,3-trifluoropropene comprises the following steps:

1) Subjecting 1,1,2,3,3-pentachloropropane and hydrogen fluoride to a reaction at a temperature of 200° C. to 350° C. and a space velocity of 60 $h^{-1}$ to 570 $h^{-1}$ under a catalysis of a chromium-based catalyst to generate 1,2-dichloro-3,3-difluoropropene, wherein a ratio of the hydrogen fluoride to the 1,1,2,3,3-pentachloropropane is (5-25):1; and 2) subjecting the 1,2-dichloro-3,3-difluoropropene and hydrogen fluoride to a reaction at a temperature of 250° C. to 400° C. and a space velocity of 50 $h^{-1}$ to 550 $h^{-1}$ under a catalysis of a catalyst to generate the 1-chloro-2,3,3-trifluoropropene, wherein the catalyst comprises a main catalyst and a cocatalyst, wherein the main catalyst is a chromium-based catalyst treated with hydrogen fluoride and the cocatalyst is one selected from the group consisting of Zn, Co, Ni, and Cu; and a ratio of the hydrogen fluoride to the 1,2-dichloro-3,3-difluoropropene is (1-8):1.

3. The method for inhibiting the flash point of the T-1,2-DCE according to claim 1, wherein the mixed solution has no flash point before boiling.

4. The method for inhibiting the flash point of the T-1,2-DCE according to claim 1, wherein the 1-chloro-2,3,3-trifluoropropene is trans-1-chloro-2,3,3-trifluoropropene.

5. A use of T-1,2-DCE, comprising: using the mixed solution obtained by the method for inhibiting the flash point of the T-1,2-DCE according to claim 1 to prepare a cleaning agent.

6. The use of the T-1,2-DCE according to claim 5, wherein the cleaning agent is placed in a closed space and heated to 45° C. to 50° C., and then an object to be cleaned is placed above a liquid level for a steam cleaning.

7. The use of the T-1,2-DCE according to claim 6, wherein the object to be cleaned is a mechanical component and an electronic device.

* * * * *